US010651018B2

(12) United States Patent
Sakuta et al.

(10) Patent No.: US 10,651,018 B2
(45) Date of Patent: May 12, 2020

(54) APPARATUS FOR AND METHOD OF MASS ANALYSIS

(71) Applicant: HITACHI HIGH-TECH SCIENCE CORPORATION, Tokyo (JP)

(72) Inventors: Masahiro Sakuta, Tokyo (JP); Yoshiki Matoba, Tokyo (JP)

(73) Assignee: HITACHI HIGH-TECH SCIENCE CORPORATION, Tokyo (JP)

( * ) Notice: Subject to any disclaimer, the term of this patent is extended or adjusted under 35 U.S.C. 154(b) by 0 days.

(21) Appl. No.: 16/244,359

(22) Filed: Jan. 10, 2019

(65) Prior Publication Data

US 2019/0214240 A1 Jul. 11, 2019

(30) Foreign Application Priority Data

Jan. 11, 2018 (JP) ..... 2018-002760

(51) Int. Cl.

| | |
|---|---|
| ***H01J 49/00*** | (2006.01) |
| ***H01J 49/34*** | (2006.01) |
| ***H01J 49/02*** | (2006.01) |
| ***H01J 49/04*** | (2006.01) |

(52) U.S. Cl.

CPC ..... *H01J 49/0036* (2013.01); *H01J 49/025* (2013.01); *H01J 49/0422* (2013.01); *H01J 49/0468* (2013.01); *H01J 49/34* (2013.01)

(58) Field of Classification Search

CPC ..... H01J 49/0036; H01J 49/025; H01J 49/02; H01J 49/426; H01J 49/0009

USPC ..... 250/281, 282

See application file for complete search history.

(56) References Cited

U.S. PATENT DOCUMENTS

2014/0179020 A1* 6/2014 Wright ..... H01J 49/0036 436/173

2016/0004815 A1* 1/2016 Lerner ..... G16B 20/00 702/19

FOREIGN PATENT DOCUMENTS

JP 2004361367 12/2004

* cited by examiner

*Primary Examiner* — Jason L McCormack

(74) *Attorney, Agent, or Firm* — Holland & Hart LLP

(57) ABSTRACT

Disclosed is an apparatus for and a method of mass analysis, the apparatus and the method being capable of improving a detection accuracy of a target substance including impurities, without increasing a size of the apparatus, and shortening measuring time. The apparatus analyzing a sample containing a target substance and one or more interfering substances, which have a peak of a mass spectrum overlapping that of the target substance includes: a peak correction unit calculating an intensity of net peak D of the mass spectrum of the target substance by subtracting a total sum of estimated intensities of the peak B, which are calculated every predetermined time interval according to the intensity of the peak A and a nonlinear relation F between the peak A and the peak B, from an intensity of peak C of a mass spectrum of the target substance of the sample.

7 Claims, 11 Drawing Sheets

APPARATUS FOR AND METHOD OF MASS ANALYSIS

CROSS REFERENCE TO RELATED APPLICATION(S)

This application claims the benefit of Japanese Patent Application No. 2018-002760, filed Jan. 11, 2018, which is hereby incorporated by reference in its entirety into this application.

BACKGROUND OF THE INVENTION

1. Technical Field

The present invention relates generally to an apparatus for and a method of mass analysis.

2. Description of the Related Art

In order to ensure a flexibility of a resin, a plasticizer such as phthalate esters is included in the resin. The use of four phthalate esters will be restricted due to European Restriction of Hazardous Substances (RoHS) since 2019. Therefore, it is required to identify and quantify phthalate esters included in a resin.

Because phthalate esters are volatile, it is possible to analyze phthalate esters by applying a conventionally known evolved gas analysis (EGA). EGA is performed by analyzing gas components, which are generated by heating a sample, with various analyzing apparatuses such as gas chromatograph and mass spectrometer.

A mass spectrometer is known and Patent Document 1 discloses a technique of performing correction calculation to measure an isotope ratio.

DOCUMENTS OF RELATED ART

Japanese Patent Application Publication No. 4256208

SUMMARY OF THE INVENTION

When quantifying dibutyl phthalate (DBP), benzyl butyl phthalate (BBP), and diethylhexyl phthalate (DEHP), which are substances to be restricted, from a sample including phthalate esters, for example, a sample including DBP, BBP, DEHP, and dioctyl terephthalate (DOTP), the above-mentioned substances have different molecular weights in general and can be distinguished through mass analysis.

However, for example, in case of quantifying DBP, when gas components generated from a sample are ionized by a mass spectrometer, fragment ions are generated from BBP, DEHP, and DOTP other than DBP such that peaks of the mass spectrum overlap that of DBP. In this case, it is difficult to accurately quantify DBP.

Alternatively, it is possible to install a gas chromatograph and separate the fragment ions before using the mass spectrometer in order to quantify DBP. However, there are problems in that the whole apparatus becomes large and the measuring time becomes long.

Accordingly, the present invention has been made keeping in mind the above problems occurring in the related art, and an objective of the present invention is to provide an apparatus for and a method of mass analysis, the apparatus and the method being capable of improving a detection accuracy of a target substance including an interfering substance such as impurities, without increasing a size of the apparatus, and capable of shortening measuring time.

In order to accomplish the above objective, the present invention provides an apparatus for mass analysis, the apparatus analyzing a sample containing a target substance, which is an organic compound, and one or more interfering substances, which are organic compounds and have a peak of a mass spectrum overlapping that of the target substance, the apparatus including: among peaks of a mass spectrum of a reference material of each of the interfering substances, based on a nonlinear relation F between intensities of peak A that does not overlap a peak of a mass spectrum of the target substance and peak B that overlaps the peak of the target substance, a peak correction unit calculating an intensity of net peak D of the mass spectrum of the target substance by subtracting a total sum of estimated intensities of the peak B, which are calculated every predetermined time interval according to the intensity of the peak A and the relation F, from an intensity of peak C of a mass spectrum of the target substance of the sample.

According to the apparatus, the influence of the interfering substance whose peak of the mass spectrum overlaps that of the target substance is subtracted based on the nonlinear relation F and the intensity of the peak A of the interfering substance that does not overlap the peak of the mass spectrum of the target substance. Thus, the intensity of the net peak D of the mass spectrum of the target substance can be accurately obtained. Accordingly, even when a relation between peak A and peak B is not linear, correction based on the relation F can be performed and the intensity of the peak D can be obtained.

Here, for example, time taken for measurement can be shortened without increasing a size of the apparatus as compared with a case, for example, where the target substance and the interfering substance are separated by a chromatograph or the like to exclude the influence of the interfering substance.

Two or more interfering substances may be present, and the peak correction unit may subtract a total sum of the estimated intensities of each of the interfering substances from the intensity of the peak C.

According to the apparatus, even when two or more interfering substances are present, the influence thereof can be accurately subtracted.

The peak correction unit may calculate the intensity of the peak D when the estimated intensity exceeds a predetermined threshold value.

According to the apparatus, when the obtained peak A is equal to or below the threshold value set as the intensity of noise or the like, it is regarded that the noise is detected and the intensity of the peak D is not calculated. Therefore, the correction of the peak D is prevented from being inaccurate.

The apparatus may further include: an ion source ionizing the target substance and the interfering substance. The peak B may be resulted from fragment ions generated from the interfering substance during the ionization.

When ionizing the interfering substance, a peak B in which the peak of the mass spectrum overlaps the target substance is likely to occur such that it can be said that the present invention is effective.

The apparatus may further include: a display controller displaying the estimated intensity and the intensity of the peak B on a predetermined display unit for each time in a superimposed manner.

According to the apparatus, it can be visually determined that the estimated intensity is correctly calculated based on the relation F as a waveform of the time variation of the estimated intensity approaches a waveform of the time variation of the intensity of the peak B.

The apparatus may further include: a display controller displaying the estimated intensity and the intensity of the peak C on a predetermined display unit for each time in a superimposed manner.

According to the apparatus, the remainder resulting from subtracting the estimated intensity from the intensity of the peak C is the intensity of the net peak D. When these waveforms (peak heights) are different from each other, it is visually determined that the estimated intensity is correctly calculated based on the relation F.

In order to accomplish the above objective, the present invention provides a method of mass analysis, the method analyzing a sample containing a target substance, which is an organic compound, and one or more interfering substances, which is an organic compound and has a peak of a mass spectrum overlapping that of the target substance, the method including: among peaks of a mass spectrum of a reference material of each of the interfering substances, based on a nonlinear relation F between intensities of peak A that does not overlap a peak of a mass spectrum of the target substance and peak B that overlaps the peak of the target substance, subtracting a total sum of estimated intensities of the peak B, which are calculated every predetermined time interval according to the intensity of the peak A and the relation F, from an intensity of peak C of a mass spectrum of the target substance of the sample to calculate an intensity of net peak D of the mass spectrum of the target substance.

According to the present invention, it is possible to improve a detection accuracy of a target substance including a interfering substance such as impurities, without increasing a size of the apparatus and to shorten measuring time.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
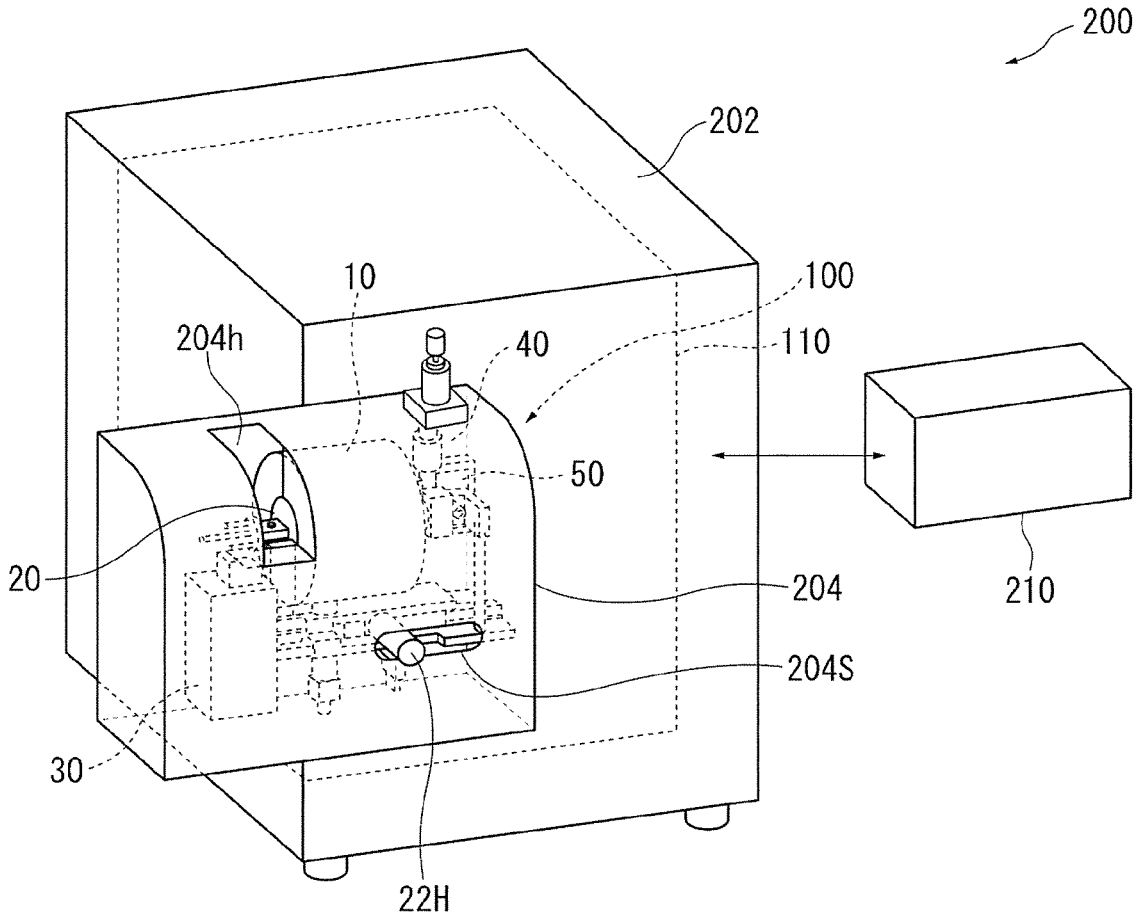
FIG. 1 is a perspective view illustrating a configuration of an evolved gas analyzer, which includes an apparatus for mass analysis according to an embodiment of the present invention.
Figure 2:
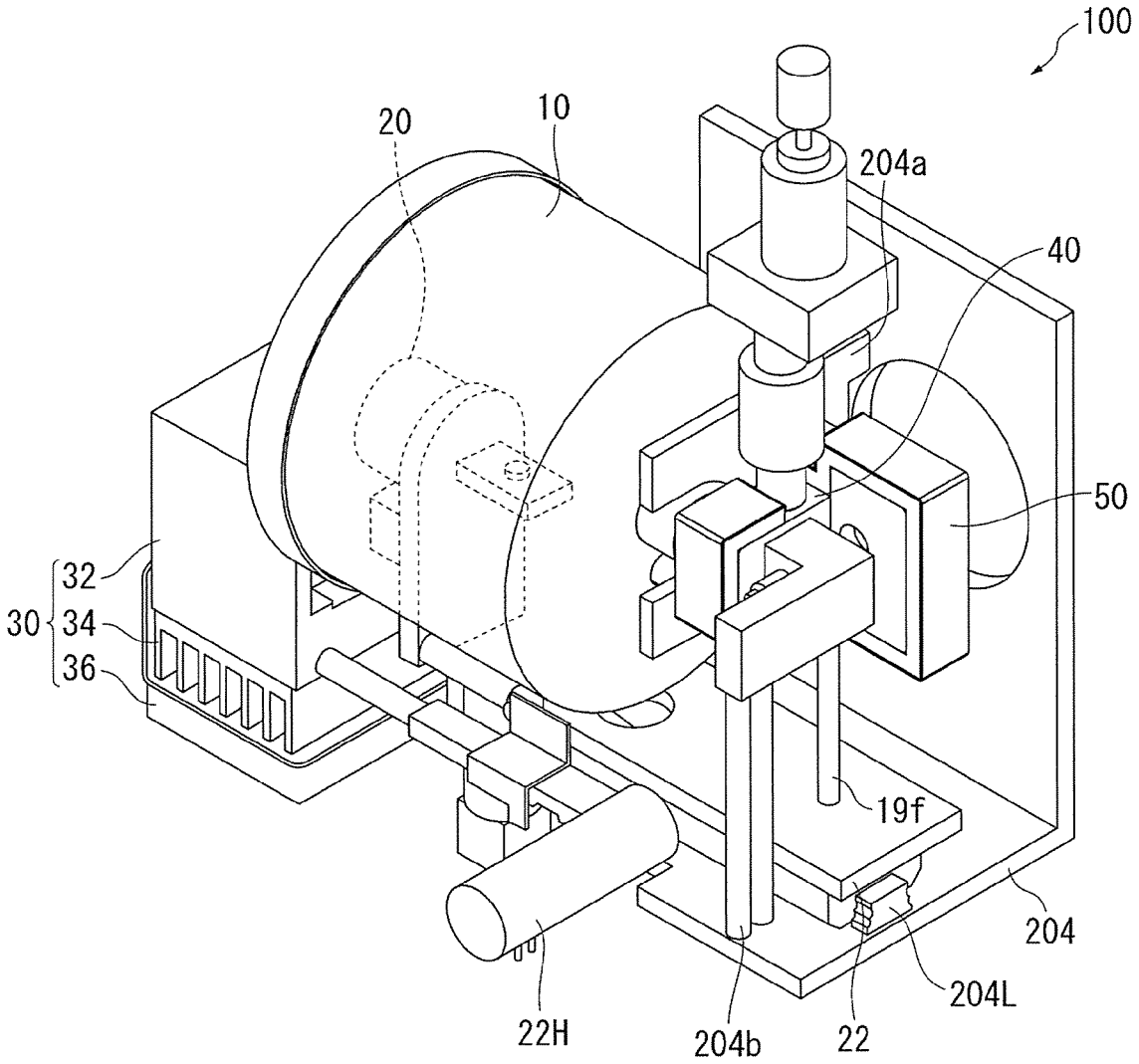
FIG. 2 is a perspective view illustrating a configuration of a gas evolving unit.
Figure 3:
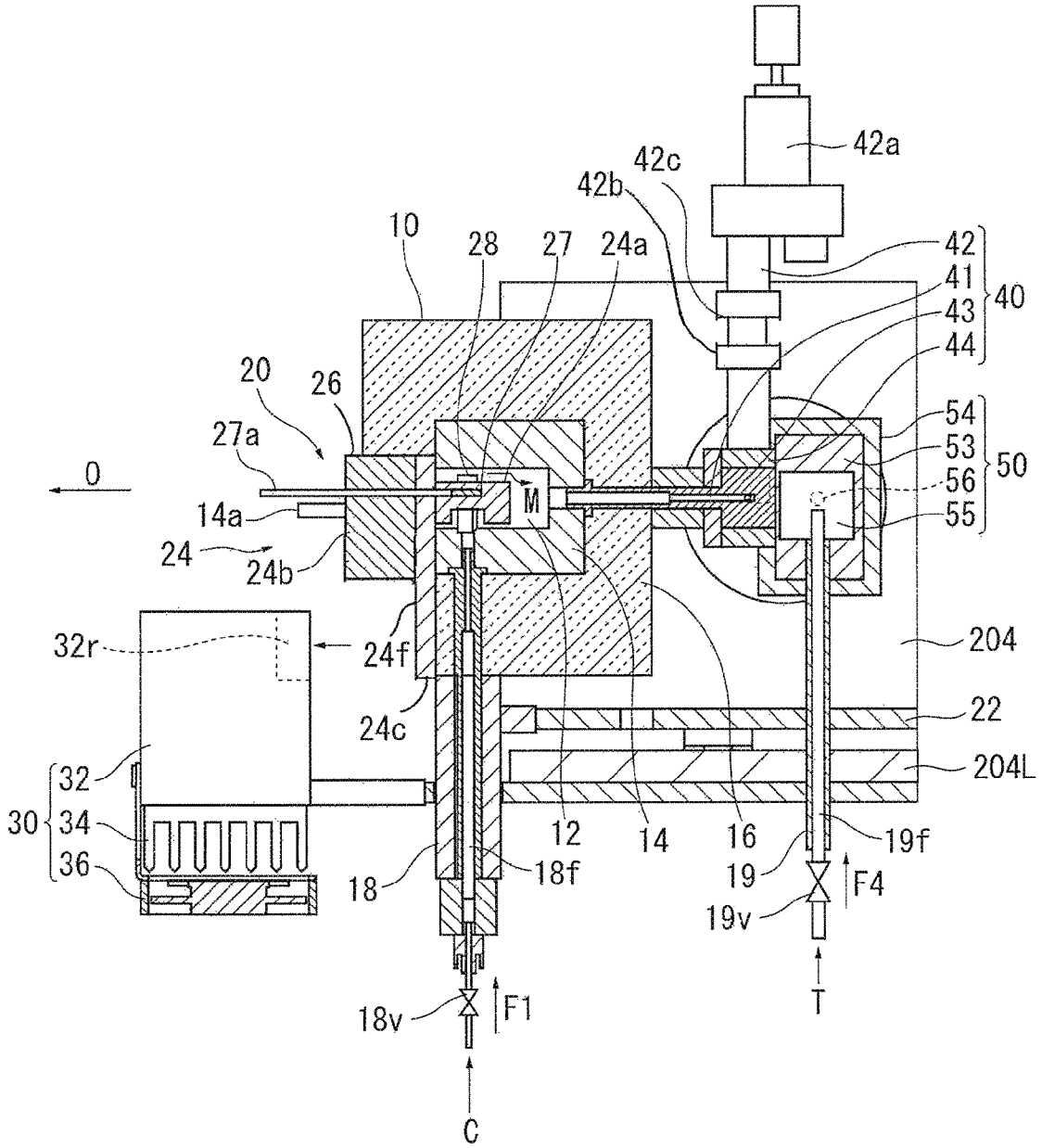
FIG. 3 is a vertical cross-sectional view illustrating the configuration of the gas evolving unit.
Figure 4:
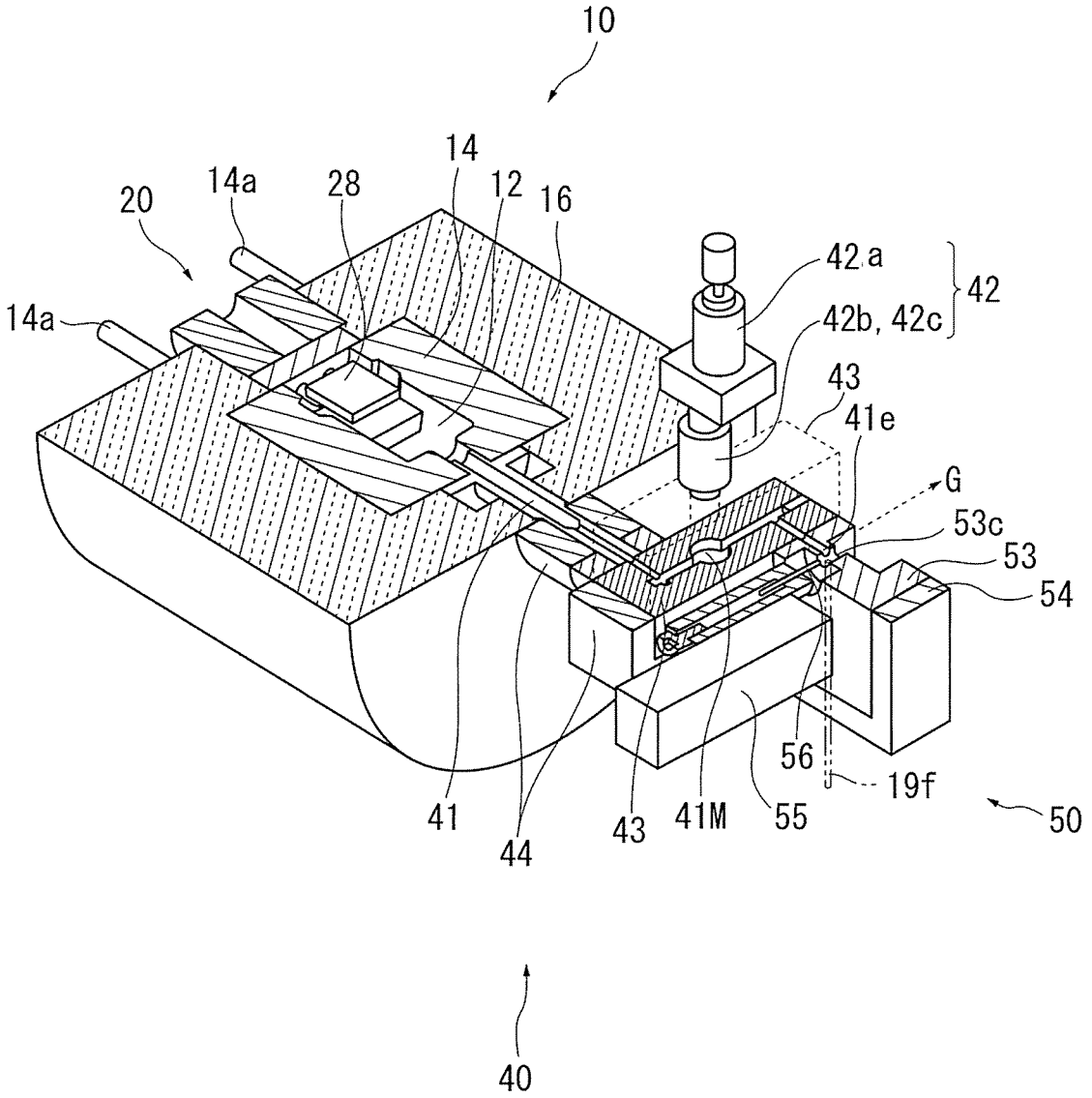
FIG. 4 is a cross-sectional view illustrating the configuration of the gas evolving unit.
Figure 5:
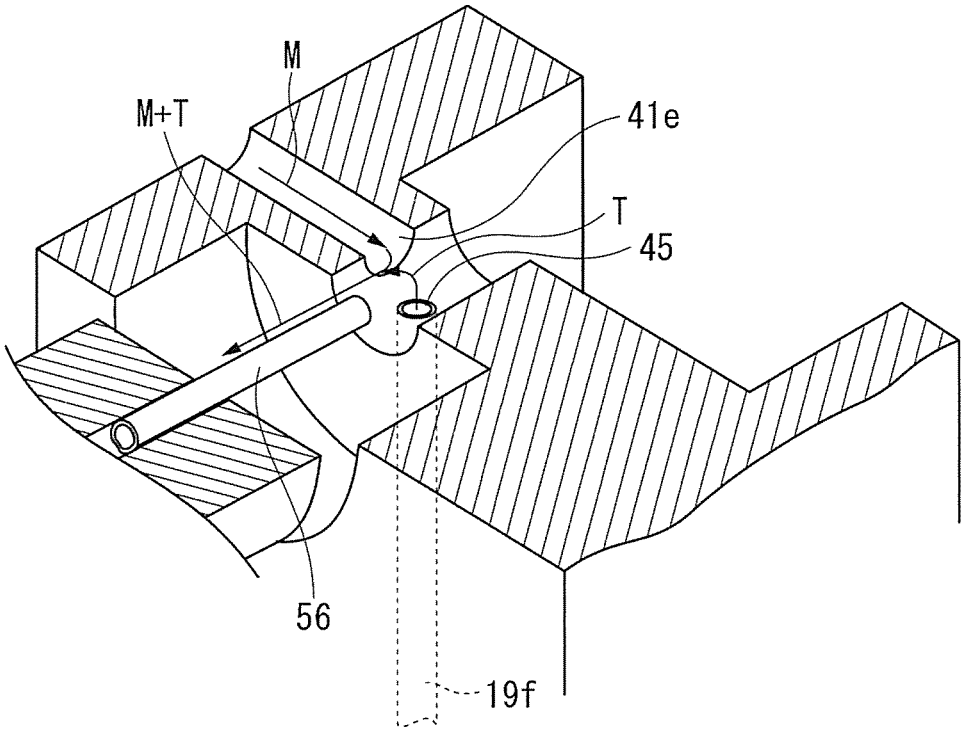
FIG. 5 is a partially enlarged view of FIG. 4.

Hereinafter, the exemplary embodiment of the present invention will be described with reference to the accompanying drawings. FIG. 1 is a perspective view illustrating a configuration of an evolved gas analyzer 200, which includes a mass spectrometer (apparatus for mass analysis) 110 according to an embodiment of the present invention; FIG. 2 is a perspective view illustrating a configuration of a gas evolving unit 100; FIG. 3 is a vertical cross-sectional view illustrating the configuration of the gas evolving unit 100 taken along an axis O; FIG. 4 is a cross-sectional view illustrating the configuration of the gas evolving unit 100 taken on the axis O; and FIG. 5 is a partially enlarged view of FIG. 4.

The evolved gas analyzer 200 is provided with the following: a body unit 202 which is a housing; a box-shaped attaching unit 204 for a gas evolving unit, the attaching unit 204 attached to a front of the body unit 202; and a computer (control unit) 210 controlling an entire system of the evolved gas analyzer. The computer 210 is provided with a CPU processing data, a memory unit 218 storing a computer program and data, a monitor 220, and an input unit such as a keyboard.

The attaching unit 204 for the gas evolving unit stores the gas evolving unit 100 as an assembly therein, the gas evolving unit 100 including a cylindrical furnace 10, a sample holder 20, a cooling unit 30, a splitter 40 splitting gas, an ion source 50, and an inerti gas flow path 19*f*. In addition, the body unit 202 stores the mass spectrometer 110 analyzing gas components evolved by heating a sample.

The ion source 50 corresponds to "ion source" in the claims.

As illustrated in FIG. 1, the attaching unit 204 for the gas evolving unit is provided with an opening 204*h* extending from upper to front surfaces thereof. The sample holder 20 is located on the opening 204*h* by moving toward a discharging position (which will be described below) that is located at an outside of the furnace 10. Thus, a sample can be supplied to or removed from the sample holder 20 through the opening 204*h*. In addition, the attaching unit 204 for the gas evolving unit is provided with a slit 204*s* at the front surface thereof. By horizontally moving an opening/closing handle 22H exposed to the outside through the slit 204*s*, the sample holder 20 is moved into or removed from the furnace 10 such that the sample holder 20 is set at the above-described discharging position to supply or remove the sample.

In addition, for example, when the sample holder 20 is moved on a moving rail 204L (which will be described below) by a stepping motor, etc. controlled by the computer 210, the sample holder 20 may be automatically moved into and removed from the furnace 10.

Hereinafter, each component in the configuration of the gas evolving unit 100 will be described with reference to FIGS. 2 to 6.

The furnace 10 is attached to an attaching plate 204*a* of the attaching unit 204 to be parallel to the axis O. The furnace 10 includes a heating chamber 12 having an approximate cylindrical shape and being open on the basis of the axis O, a heating block 14, and a heat retaining jacket 16.

The heat retaining jacket 16 surrounds the heating block 14, and the heating block 14 surrounds the heating chamber 12. The heating block 14 is made of aluminum and is resistive-heated by a pair of heating electrodes 14*a* extending from the furnace 10 to the outside in a direction of the axis O as illustrated in FIG. 4.

In addition, the attaching plate 204*a* extends in a direction perpendicular to the axis O. The splitter 40 and the ion source 50 are attached to the furnace 10. In addition, the ion source 50 is supported by a supporter 204*b* extending in a vertical direction of the attaching unit 204.

The splitter 40 is connected to an additional side (right side of FIG. 3) of the furnace 10, which is next to a first side, which is an opening side of the furnace 10. In addition, a carrier gas protecting pipe 18 is connected to a lower portion of the furnace 10 and stores a carrier gas channel 18*f* therein, the carrier gas channel 18*f* being connected to a lower surface of the heating chamber 12 and introducing carrier gas C into the heating chamber 12 therethrough. In addition, the carrier gas channel 18*f* is provided with a control valve 18*v* controlling a flow rate F1 of the carrier gas C.

Furthermore, a mixed gas channel 41 communicates with the additional side (right side of FIG. 3) of the heating chamber 12 such that mixed gas M of gas component G evolved from the furnace 10 (heating chamber 12) and the carrier gas C flows in the mixed gas channel 41. A detailed description will be provided later.

Meanwhile, as illustrated in FIG. 3, the ion source 50 is connected to an inerti gas protecting pipe 19 at a lower side thereof, and the inerti gas protecting pipe 19 stores the inerti gas flow path 19*f* through which inerti gas T is introduced into the ion source 50. In addition, the inerti gas flow path 19*f* is provided with a control valve 19*v* controlling a flow rate F4 of the inerti gas T.

The sample holder 20 is provided with the following: a stage 22 moving on the moving rail 204L attached to an inner upper surface of the attaching unit 204; a bracket 24*c* attached on the stage 22 and extending vertically; insulators 24*b* and 26 attached to a front surface (left side of FIG. 3) of the bracket 24*c*; a sample holding unit 24*a* extending from the bracket 24*c* to the heating chamber 12 in the direction of the axis O; a sample heater 27 provided immediately below the sample holding unit 24*a*; and a sample plate 28 which is provided on an upper surface of the sample holding unit 24*a* and above the sample heater 27 and on which the sample is placed.

Here, the moving rail 204L extends in the direction of the axis O (horizontal direction in FIG. 3), and the sample holder 20 moves back and forth by the stage 22 in the direction of the axis O. In addition, the opening/closing handle 22H is attached to the stage 22 and extends in the direction perpendicular to the axis O.

In addition, the bracket 24*c* has a semicircular upper portion and a long rectangular lower portion. Referring to FIG. 3, the insulator 24*b* has an approximately cylindrical shape and is provided at a front surface of the upper portion of the bracket 24*c*, and an electrode 27*a* of the sample heater 27 penetrates the insulator 24*b* and protrudes to outside the gas evolving unit. The insulator 26 has an approximately rectangular shape and is provided at the front surface of the bracket 24*c* and below the insulator 24*b*. In addition, a lower portion of the bracket 24*c* is provided without the insulator 26 such that a front surface of the lower portion of the bracket 24*c* is uncovered to provide a contact surface 24*f*.

The bracket 24*c* has a diameter slightly larger than that of the heating chamber 12 such that the bracket 24 seals the heating chamber 12 tightly, and the heating chamber 12 stores the sample holding unit 24*a* therein.

In addition, a sample placed on the sample plate 28 of the heating chamber 12 is heated in the furnace 10 such that gas component G is evolved.

The cooling unit 30 is disposed at the outside of the furnace 10 (left side of the furnace 10 in FIG. 3) to face the bracket 24*c* of the sample holder 20. The cooling unit 30 is provided with a cooling block 32 having a substantially rectangular shape and having a recessed portion 32*r*; cooling fins 34 connected to a lower surface of the cooling block 32; and a pneumatic cooling fan 36 connected to a lower surface of the cooling fins 34 and blowing air to the cooling fins 34.

In addition, when the sample holder 20 moves in the direction of the axis O on the moving rail 204L toward the left side of FIG. 3 and comes out of the furnace 10, the contact surface 24*f* of the bracket 24*c* is positioned at and contacts with the recessed portion 32*r* of the cooling block 32. Accordingly, the cooling block 32 absorbs heat of the bracket 24*c* whereby the sample holder 20 (particularly, the sample holding unit 24*a*) is cooled.

As illustrated in FIGS. 3 and 4, the splitter 40 is provided with the above-described mixed gas channel 41 communicating with the heating chamber 12; a branching channel 42 communicating with the mixed gas channel 41 and being exposed to the outside of the gas evolving unit; a back pressure valve 42*a* connected to a discharge side of the branching channel 42 to control a flow rate of the mixed gas M discharged through the branching channel 42; a housing unit 43 in which the end of the mixed gas flow path 41 is opened; and a heat retaining unit 44 surrounding the housing unit 43.

In addition, in this embodiment, a filter 42*b* and a flowmetcr 42*c* is disposed between the branching channel 42 and the back pressure valve 42*a*, the filter 42*b* removing a interfering substance in the mixed gas. An end of the branching channel 42 may be exposed without a valve controlling a back pressure, such as back pressure valve 42*a*, etc.

As illustrated in FIG. 4, when viewed from the top, the mixed gas channel 41 is connected to the heating chamber 12 and extends in the direction of the axis O. Then, the mixed gas channel 41 bends in a direction perpendicular to the axis O and bends again in the direction of the axis O such that the mixed gas channel 41 reaches an end part 41*e* and has a crank shape. In addition, in the vicinity of the center of a portion of the mixed gas flow path 41 which extends in the direction perpendicular to the axis O, a diameter is enlarged to define a branch chamber 41M. The branch chamber 41M extends to an upper surface of the housing unit 43 and is fitted with the branching channel 42 having a diameter slightly smaller than that of the branch chamber 41M.

The mixed gas channel 41 may have a straight line shape, which is connected to 30) the heating chamber 12, extends in the direction of the axis O, and reaches to the end part 41*e*. Alternatively, the mixed gas channel 41 may be a various curved shape or a linear shape having a predetermined angle with the axis O, etc., depending on a positional relationship with the heating chamber 12 or with the ion source 50.

As illustrated in FIGS. 3 and 4, the ion source 50 is provided with an ionizer housing unit 53, an ionizer heat retaining unit 54 surrounding the ionizer housing unit 53, a discharge needle 56, and a staying unit 55 fixing the discharge needle 56. The ionizer housing unit 53 has a plate shape, and a surface thereof is parallel to the axis O and is penetrated by a small hole 53*c* at the center thereof. In addition, the end part 41*e* of the mixed gas channel 41 penetrates the ionizer housing unit 53 and faces a side wall of the small hole 53*c*. Meanwhile, the discharge needle 56 extends in the direction perpendicular to the axis O and faces the small hole 53*c*.

As illustrated in FIGS. 4 and 5, the inerti gas flow path 19*f* penetrates the ionizer housing unit 53 vertically, and a front end of the inerti gas flow path 19*f* faces a bottom surface of the small hole 53*c* of the ionizer housing unit 53 and provides a junction 45 joining the end part 41*e* of the mixed gas channel 41.

In addition, with regard to the mixed gas M introduced from the end part 41*e* to the junction 45, which is near the small hole 53*c*, the mixed gas M is mixed with the inerti gas T introduced from the inerti gas flow path 19*f* such that combined gas (M+T) flows toward the discharge needle 56 and the gas component G among the combined gas (M+T) is ionized by the discharge needle 56.

The ion source 50 is a well-known device. This embodiment applies atmospheric pressure chemical ionization (APCI) as the ion source 50. It is hard to cause fragment of the gas component G by the APCI such that fragment peak does not occur. Therefore, it is preferable in that it is possible to detect the object to be measured without separating the gas component G by a chromatograph or the like.

The gas component G ionized at the ion source 50, the carrier gas C, and the inerti gas T are introduced to the mass spectrometer 110 and analyzed.

The ion source 50 is stored in the ionizer heat retaining unit 54.

Figure 6:
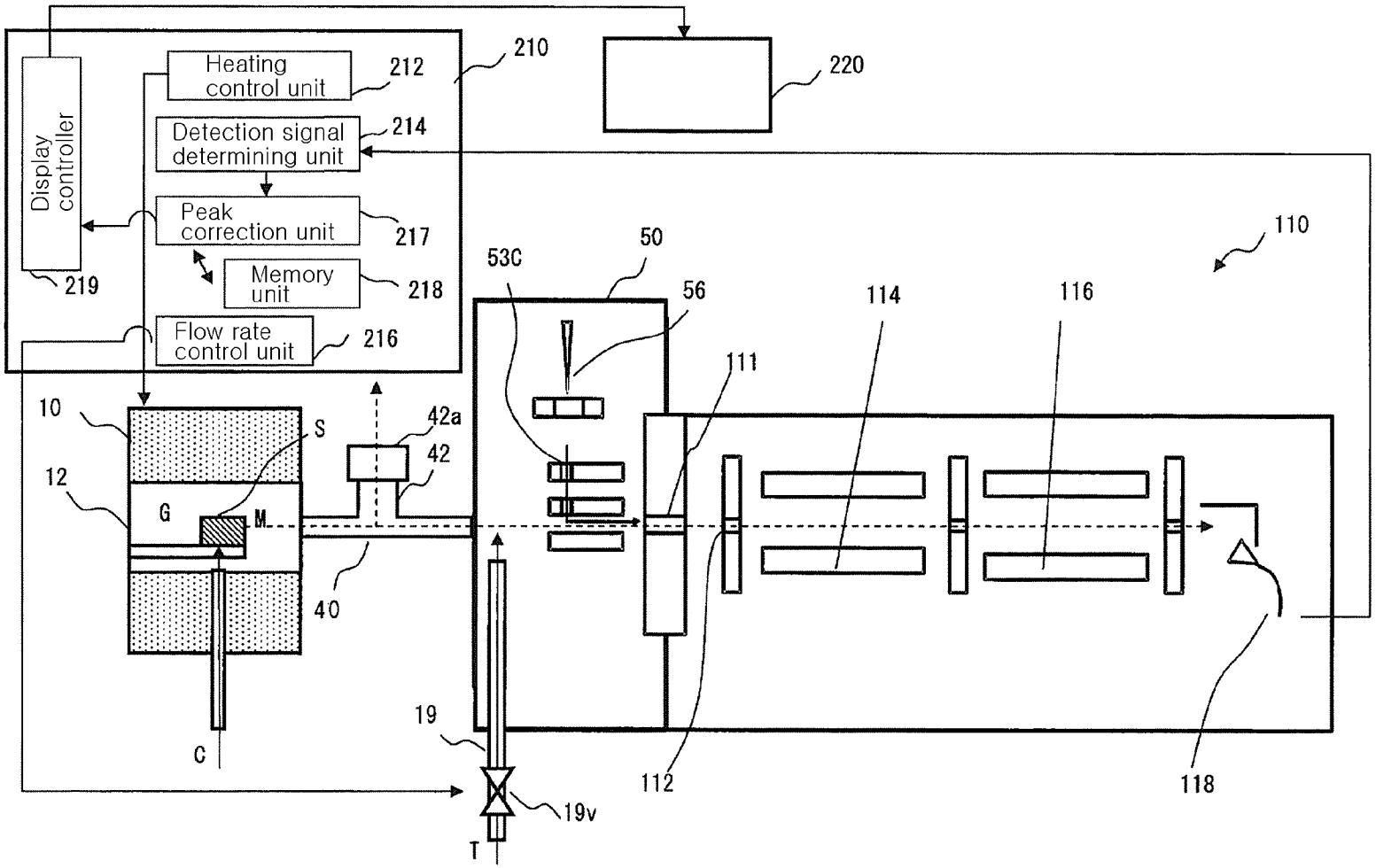
FIG. 6 is a block diagram illustrating a process of analyzing a gas component by the evolved gas analyzer.

FIG. 6 is a block diagram illustrating a process of analyzing a gas component by the evolved gas analyzer 200.

A sample S is heated in the heating chamber 12 of the furnace 10, and the gas component G is evolved. A heating condition (temperature rising rate, maximum temperature, etc.) of the furnace 10 is controlled by a heating control unit 212 of the computer 210.

The gas component G is mixed with the carrier gas C introduced in the heating chamber 12 to be the mixed gas M. The mixed gas M is introduced in the splitter 40 and some of the mixed gas M is discharged to the outside through the branching channel 42.

A remaining mixed gas M and the inerti gas T introduced from the inerti gas flow path 19*f* are introduced to the ion source 50 as the combined gas (M+T), and the gas component G is ionized.

A detection signal determining unit 214 of the computer 210 receives a detection signal from a detector 118 (which will be described later) of the mass spectrometer 110.

A flow rate control unit 216 determines whether peak intensity of the detection signal received from the detection signal determining unit 214 is within a threshold range. When the peak intensity is out of the threshold range, the flow rate control unit 216 controls an opening ratio of the control valve 19*v* such that a flow rate of the mixed gas M discharged from the splitter 40 to the outside through the branching channel 42, and further, a flow rate of the mixed gas M introduced from the mixed gas channel 41 to the ion source 50 is controlled, whereby a detection accuracy of the mass spectrometer 110 is maintained optimally.

The mass spectrometer 110 is provided with a first aperture 111 through which the gas component G ionized at the ion source 50 is introduced; a additional aperture 112 through which the gas component G flows after the first aperture 111; an ion guide 114; a quadrupole mass filter 116; and the detector 118 detecting the gas component G discharged from the quadrupole mass filter 116.

The quadrupole mass filter 116 varies an applying high frequency voltage such that mass is scanned. The quadrupole mass filter 116 generates a quadrupole electric field and detects ions by moving the ions like a pendulum swinging within the quadrupole electric field. The quadrupole mass filter 116 serves as a mass separator passing only the gas component G within a predetermined mass range such that the detector 118 may identify and quantify the gas component G.

In addition, in this embodiment, because the inerti gas T flows to the mixed gas channel 41 from a downstream of the branching channel 42, the inerti gas T becomes a flow resistance that suppresses the flow rate of the mixed gas M introduced to the mass spectrometer 110 such that the inerti gas T controls the flow rate of the mixed gas M discharged from the branching channel 42. In detail, as the flow rate of the inerti gas T increases, the flow rate of the mixed gas M discharged from the branching channel 42 increases.

Accordingly, when a large amount of the gas component is evolved and a gas concentration becomes too high, the flow rate of the mixed gas discharged from the branching channel to the outside is allowed to be increased to prevent a detection signal from exceeding a detection range of the detector, whereby the measurement can be accurate.

Hereinafter, a peak correction of a mass spectrum, which is a characteristic of the present invention, will be described with reference to FIGS. 7 to 12. A sample is a polyvinyl chloride and it is assumed that the dibutyl phthalate (DBP), benzyl butyl phthalate (BBP), diethylhexyl phthalate (DEHP), and dioctyl terephthalate (DOTP), which are phthalate esters, are included in the sample as plasticizers. DBP, a restricted substance that is one of phthalate esters, is referred to as "target substance" in the claims. The target substance is an object to be measured.

Figure 7:
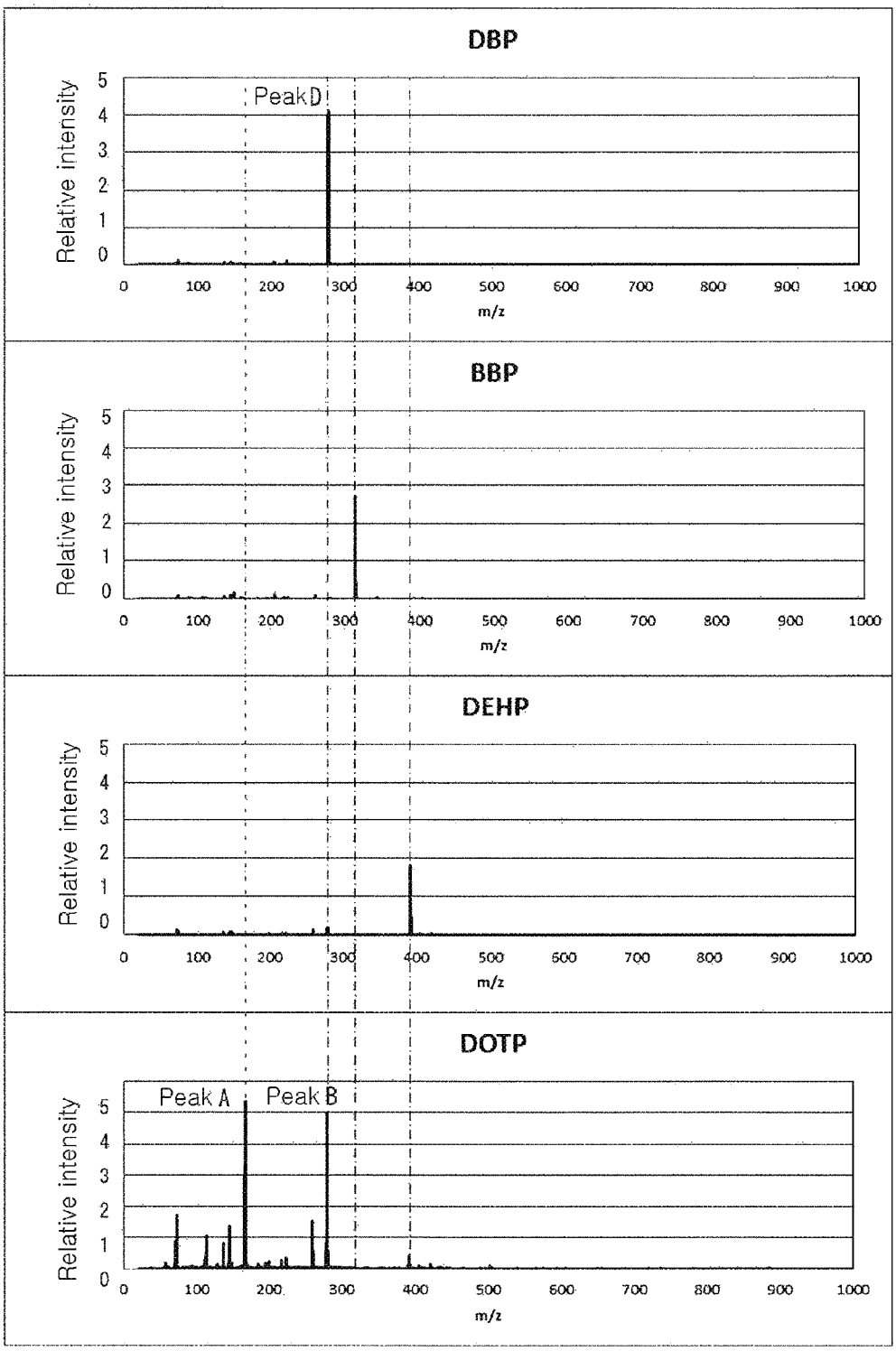
FIG. 7 is a view individually illustrating mass spectrum from reference standard materials of DBP, BBP, DEHP and DOTP.

FIG. 7 is a view individually illustrating mass spectrum from reference materials of DBP, BBP, DEHP and DOTP. Intensities on vertical axes in FIGS. 7 and 8 are relative values.

As illustrated in FIG. 7, the mass spectrum of DBP has a peak (net peak D) at a mass-to-charge ratio (m/z) of about 280, and DBP is usually quantified using this peak D. Each peak of the mass spectrum of BBP and DEHP has a mass-to-charge ratio (m/z) different from the peak D of DBP and does not interfere with the quantification of DBP since the peaks do not overlap the peak D of DBP.

However, DOTP is cleaved at the time of ionization by the mass spectrometer such that fragment ions are generated. As illustrated in FIG. 7, one fragment ion appears as peak B overlapping the peak D of DBP. Therefore, DOTP is referred to as "interfering substance" in the claims. The interfering substance is impurities.

Figure 8:
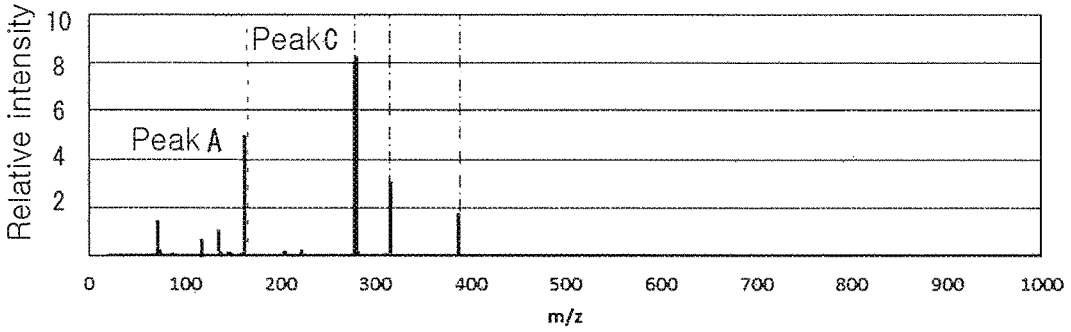
FIG. 8 is a view illustrating a mass spectrum of a sample in which DBP and DOTP are mixed.

Since the peak D overlaps the peak B, when measuring the mass spectrum of the sample in which DBP and DOTP are mixed, an intensity of a peak of DBP (hereinafter, referred to as "peak C") having a mass-to-charge ratio (m/z) of about 280 is the sum of the intensities of peak B and peak D as illustrated in FIG. 8. Thus, the intensity of the peak C becomes higher than that of the net peak D of DBP, which is the case that the sample does not contain DOTP.

Figure 9:
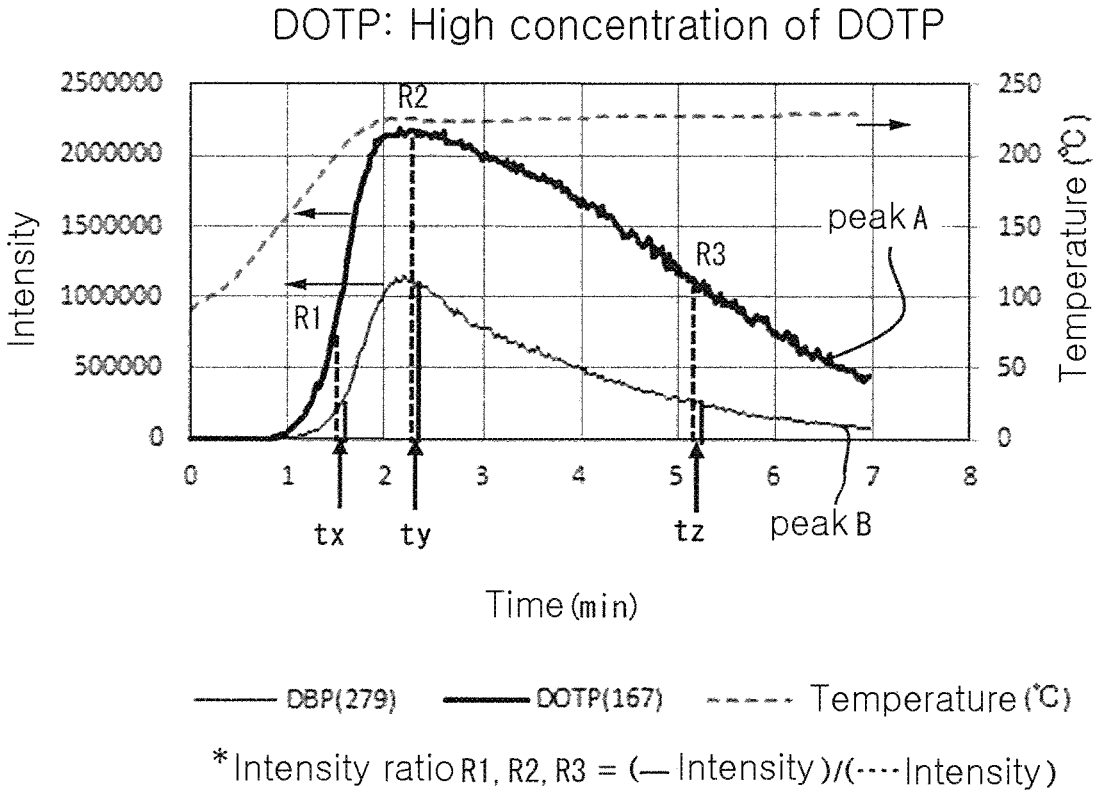
FIG. 9 is a view illustrating changes of each intensity of peak A and peak B of DOTP over time.

Here, in the mass spectrum of DOTP (fragment ion of the mass spectrum of DOTP), peak A does not overlap the peak D. It is also found that a generation ratio of each fragment ion resulting from the cleavage of DOTP changes over time, and an intensity ratio (peak B)/(peak A) also changes over time as illustrated in FIG. 9. For example, in the example of FIG. 9, when compared with an intensity ratio R1 at a time tx, an intensity ratio R2 at a subsequent time ty is decreased. In addition, an intensity ratio R3 at a time tz, which has elapsed further, is increased compared with the intensity ratio R2.

The reason for this is considered as follows. Generally, the gas generation amount (ion concentration) in the heating process of the sample to be measured of the mass spectrum differs depending on elapsed time from the start of heating. At a time t1 in an initial stage of heating, heat is not sufficiently transferred to the entire sample, and the gas generation amount is small. At a time t2 in a middle stage of heating, the gas generation amount is the largest. At the time t3 in a terminal stage of heating, gas contained in the sample completely deviates such that the gas generation amount is decreased.

Because this tendency differs depending on each fragment ion, the intensity ratio (peak B)/(peak A) also changes over time.

Therefore, it is possible to accurately correct the intensity of the peak C by calculating the relation between the intensities of the peak A and the peak B in every same time and reflecting this to the amount of subtracting the intensity of the peak B from the intensity of the peak C.

Here, when the time elapses from the start of heating, the concentration of the fragment ion indicating the peak B increases beyond a threshold value, and a phenomenon such as a suppression in which a ratio of the ion concentration and a detection intensity deviates from a proportional relation occurs, which may seem as if R2 is decreasing. That is, the changes over time in the relation between the intensities of the peak A and the peak B may be replaced with the relation between the intensities of the peak A and the peak B which change over time.

Figure 10:
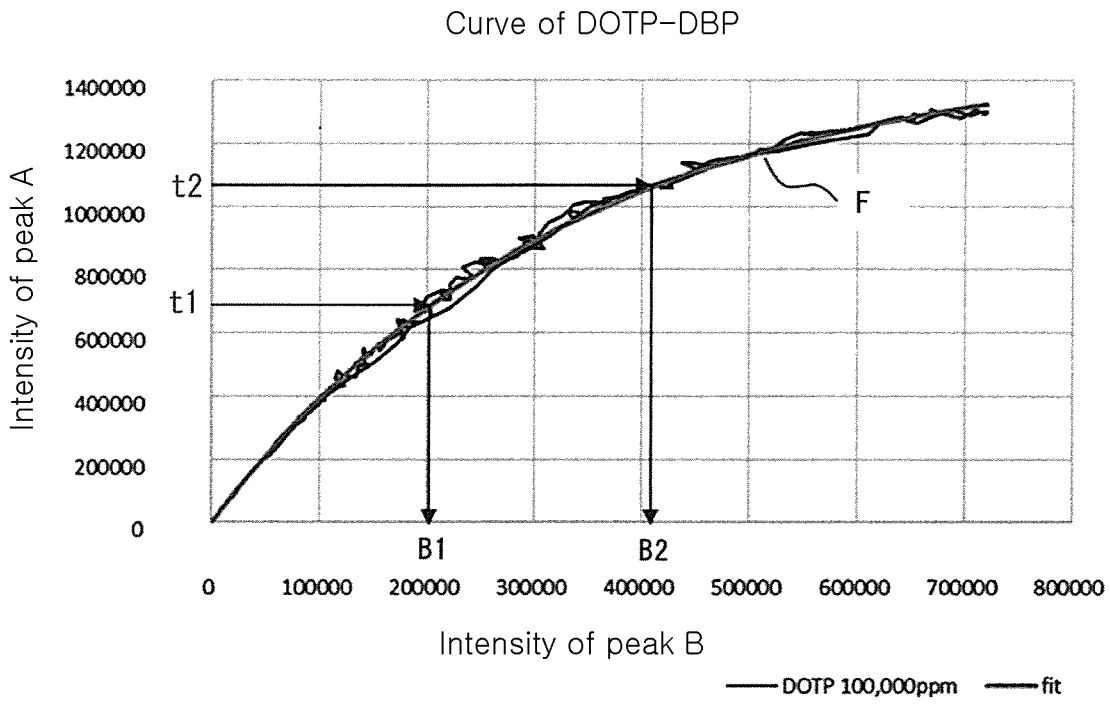
FIG. 10 is a view illustrating an intensity relation between the peak A and the peak B of DOTP.

Thus, as illustrated in FIG. 10, when plotting the relation between the intensities of the peak A and the peak B in every same time, it was found that there was a nonlinear relation F between the intensities of the peak A and the peak B. This relation F may be, for example, an approximate curve of the plot of FIG. 10. In a concrete example, the relation F may be exemplified by a table in which concrete numerical values of the intensities of the peak A and the peak B are associated with each other, in addition to nonlinear relational expressions such as an exponential function or a polynomial.

Then, the intensity of the peak A may be measured at each of the times t1, t2, . . . having predetermined time intervals Δt, and estimated intensities B1 and B2 of the peak B can be calculated according to the intensity of the peak A and the relation F. When the relation F is in a table form and there is an actually measured value of the intensity of the peak A between values filled in the table, the estimated intensity of the peak B may be calculated by extrapolation or the like.

When the total sum of the estimated intensities B1 and B2 is used as a correction amount and subtracted from the intensity of the peak C, it is possible to calculate an intensity of the net peak D.

In particular, for example, an allowable threshold value of phthalate esters is generally restricted to be 1000 ppm, whereas DOTP that generates interference fragments is included as 100,000 ppm order. Therefore, if the relation between the intensities of the peak A and the peak B, which is the basis of the calculation of the correction amount, deviates even slightly from the actual value, the correction amount error becomes large. Accordingly, by using the high precision nonlinear relation F which reflects the intensities of the peak A and the peak B, it is possible to obtain the correction amount with high accuracy.

In addition, generally, there are cases where two or more interfering substances are present in the sample. In this case, when calculating the intensity of the net peak D, the total sum of estimated intensities of the individual interfering substances is subtracted from the intensity of the peak C.

When noise is detected as the peak A during the measurement, an error occurs in the correction. Therefore, the intensity of the peak D may be calculated when the estimated intensity exceeds a predetermined threshold value (background assumed to be noise).

Hereinafter, an example of a detailed correction processing performed by a peak correction unit 217 will be described.

The relation F between the peak A and the peak B, which is nonlinear illustrated in FIG. 10, is obtained in advance. Specifically, a sample containing only DOTP is analyzed by a mass spectrometer, and an intensity of peak A of DOTP at that time and an intensity of peak B derived from fragment ions cleaved from DOTP are measured at the same time in time series analysis. As a result, the result as illustrated in FIG. 9 is obtained whereby it is possible to obtain the nonlinear relation F between the intensities of the peak A and the peak B, illustrated in FIG. 10.

Then, the actual sample is analyzed by the mass spectrometer at a predetermined time interval Δt. As illustrated in FIG. 10, the intensity of the peak A is measured at time t1, t2, t3, . . . of the predetermined time interval Δt. Intensities B1, B2, B3 of the peak B are calculated according to the relation F with the intensity of the peak A, and the obtained values become estimated intensities.

The intensity of the peak D is calculated by subtracting the total sum of the estimated intensities B1, B2, B3, . . . from the intensity of the peak C.

Figure 11:
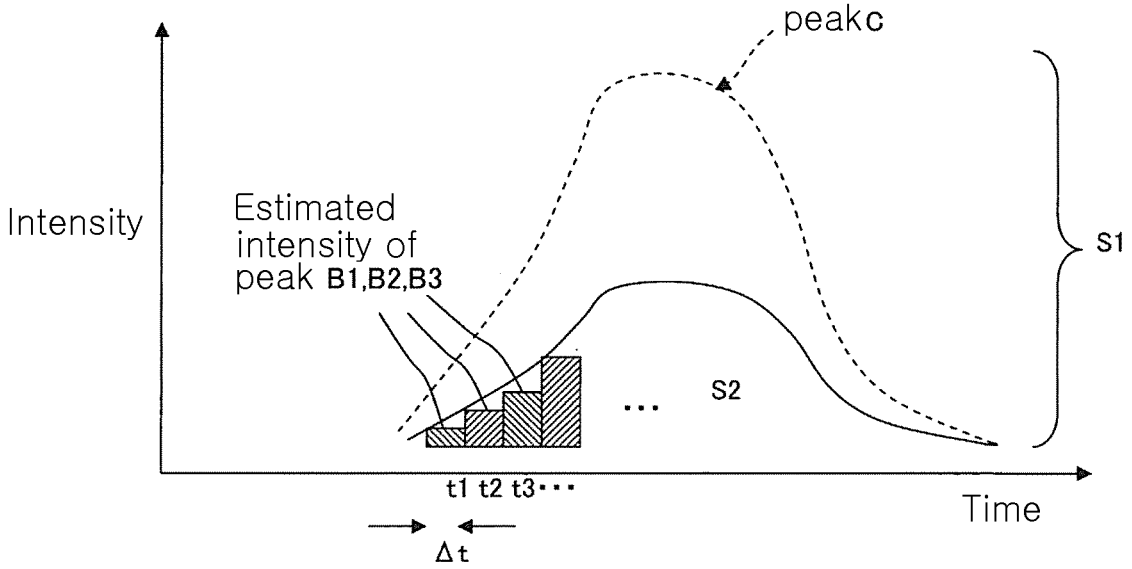
FIG. 11 is a view illustrating a procedure for subtracting a total sum of estimated intensities of the peak B from the intensities of the peaks C.

FIG. 11 is a schematic view illustrating a procedure for subtracting the total sum of the estimated intensities B1, B2, B3, . . . from the intensities of the peaks C.

Each of the estimated intensities B1, B2, B3, . . . of the peak B at the times t1, t2, t3, . . . of the predetermined time interval Δt is multiplied by the time interval Δt to obtain peak areas (hatched areas in FIG. 11), respectively. Then, the total sum of these peak areas is defined as total sum S2 of the estimated intensities B1, B2, B3, . . . .

By subtracting the total sum S2 from an intensity (an area of the peak C in FIG. 11) S1 of the peak C, an intensity of the peak D is obtained.

Hereinafter, a detailed example of the process illustrated in FIG. 11 will be described.

The peak correction unit 217 calculates an estimated intensity according to Equation 1.

$$a_i' = a_i - \sum_{m=1}^{m} T(A_{im}, g \cdot a_i). \tag{1}$$

In Equation 1, $a_i$ is a peak intensity (area) of the target substance to be subjected, $A_{im}$ is the following Equation 2, i and m is natural number of 1 or more, and n is the total number of the target substance and the interfering substance (number of components). In the example of FIG. 7, n=2 because there are one target substance and one interfering substance. In this case, it is assumed that i=m=1, that is, a1 is the intensity of the peak C of the target substance before correction, and i=m=2, that is, $A_{22}$ is the intensity of the peak A of only the interfering substance before correction.

$A_{im}$ is expressed as Equation 2.

$$A_{im} = \sum_{i=1}^{T_0} f(x_m^{(i)}; w_{im})\Delta_t \tag{2}$$

In Equation 2, f(x; w) is a fitting function, $x^{(t)}m$ is a peak intensity of a component m at time t, $T_0$ is a measurement data point, $w_{im}$ is a function parameter, and Δt is the time interval described above.

Here, assuming that i=1 is the target substance DBP and i=2 is the interfering substance DOTP, in this case, Equation 1 is expressed in the following two equations.

$$a_1' = a_1 - \{T(A_{11}, g \times a_1) + T(A_{12}, g \times a_1)\}$$

$$a_2' = a_2 - \{T(A_{21}, g \times a_2) + T(A_{22}, g \times a_2)\}$$

That is, in Equation 1, the target substance DBP and the interfering substance DOTP are symmetrical and distinguished by the values of i and m. That is, when it is desired to use the interfering substance DOTP as the target substance, it is also possible to quantify the interfering substance DOTP simultaneously by Equation 1.

Thus, by treating the target substance and the interfering substance symmetrically in Equation 1, for example, when an intensity ratio of substances changes depending on measurement conditions, the target substance and the interfering substance affecting each other are measured at the same time such that there is a possibility that an optimum condition of measurement is obtained.

Here, in the case of i=m, because the target substance and the interfering substance are the same, $A_{11}=A_{22}=0$ and this is not included in the correction, the two equations become the following equations.

$$a_1' = a_1 - \{T(A_{12}, g \times a_1)\}$$

$$a_2' = a_2 - \{T(A_{21}, g \times a_2)\}$$

A description will be focused on only the former equation associated with the target substance. The later equation is symmetrical with the former equation with reference to the interfering substance.

By substituting Equation 2, the former equation becomes the following Equation 3.

$$a_1' = a_1 - \left\{T\left(\sum_{t=1}^{T_0} \{f(x_2^{(t)}; w_{12})\Delta_t\}, g \times a_1\right)\right\} \tag{3}$$

Specifically, Equation 3 becomes the following Equation 4.

[Intensity of peak $D$]=[Intensity of peak $C$()−$T(A_{12}$, $g$×[Intensity of peak $C$])

$$A_{12} = \sum_{t=1}^{T_0} f([\text{Instantaneous intenstiy of peak } A \text{ at time } t]; w_{12}) \times \Delta_t \tag{4}$$

Here, $w_{12}$ is a function parameter. When g=0.01, g×(intensity of peak C) is 1% of the intensity of the peak C and this value is a threshold value.

As shown in FIG. 10, $w_{12}$ is a parameter for determining a form of the function f (x; w) corresponding to the relation F obtaining the value of the peak B, from the peak A of the interfering substance DOTP, which is i=2, f (x; w) is a function determined by a variable x and a parameter w, and the number of parameters may be plural depending on the form of the function. For example, when the function is a quadratic function such as $f(x; w)=w^{(0)}+w^{(1)}x+w^{(2)}x^2$, the number of parameters is three and $w^{(0)}$, $w^{(1)}$, $w^{(2)}$ are the function parameters $w_{12}$. To generalize this, w is expressed as a vector and w in bold is a vector, meaning that this contains a plurality of components. For example, when there are three components, $w=(w^{(0)}, w^{(1)}, w^{(2)})$.

In the example of FIG. 10, the form of the function corresponding to the relation F is defined in the following Equation 5 with two component parameters. A calculation of the parameters is performed by fitting on measured data using a known algorithm such as a least squares method.

$$f(x; w) = -\frac{1}{w^{(1)}}\log(w^{(0)} - x) \tag{5}$$

Equation 5 is an inverse function of Equation 6.

$$f^{-1}(x; w) = w^{(0)}\left(1 - \exp\left(-\frac{z}{w^{(1)}}\right)\right) \tag{6}$$

In the examples of Equations 5 and 6, superscripts of $w^{(0)}$ and $w^{(1)}$ are different from i and m and represent different function parameters. For example, in Equation 5, when a plot of FIG. 10 is approximated in an exponential function, two parameters are $w^{(0)}$ and $w^{(1)}$. In Equations 5 and 6, w represents a vector, and $w_{im}$, which shows components, is omitted so as not to be complicated.

With respect to the fitting, it is preferable that the inverse function, Equation 6, is adopted instead of Equation 5 such that the fitting is carried out reliably.

g is a truncation coefficient, and in this example, g=0.01 is set. $g \cdot a_i$ is a threshold value assuming an intensity of noise.

T is a truncation function and is expressed in Equation 7 below.

$$T(x, t) = \begin{cases} x & \text{if } t < x \\ 0 & \text{otherwise} \end{cases} \tag{7}$$

Figure 12:
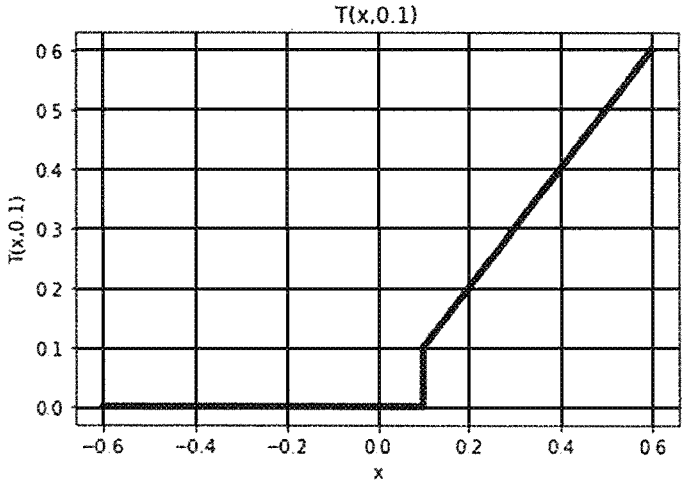
FIG. 12 is a view illustrating a T function.

As illustrated in FIG. 12, T returns a value x ($A_{im}$ in Equation 2) when the value x exceeds the threshold value t ($g \cdot a_i$ in Equation 1), and returns 0 when the value x is equal to or below the threshold value t.

Therefore, when $\Sigma_t\{f(x_2^{(t)}; w_{12})\Delta_t\}$>{threshold value g×(intensity of peak C)}, T (the truncation function) of Equation 7 regards $\Sigma_t\{f(x_2^{(t)}; w_{12})\Delta_t\}$ as a true value, not a noise according to Equation 2 and outputs a value of $\Sigma_t\{f(x_2^{(t)}; w_{12})\Delta_t\}$. Conversely, when $\Sigma_t\{f(x_2^{(t)}; w_{12})\Delta_t\}$≤{threshold value g×(intensity of peak C)}, peak A is regarded as noise and 0 is returned, and correction is not performed.

Next, the above-described peak correction processing will be described with reference to FIG. 6.

The nonlinear relation F (function parameter $w_{12}$) is stored in the memory unit 218 such as a hard disk in advance. For example, an operator specifies a target substance and a interfering substance using a keyboard or the like and sets a sample containing the target substance and the interfering substance.

The detection signal determining unit 214 of the computer 210 acquires peaks of mass spectrum (peak A and peak C in this example) of the target substance and the interfering substance at intervals of Δt.

The peak correction unit 217 of the computer 210 reads the function parameter $w_{12}$ from the memory unit 218 to acquire the peak A and the peak C from the detection signal determining unit 214 in every time interval Δt and calculates an intensity of the net peak D according to Equations 1 to 7 as described above. Equations 1 to 7 are stored in the memory unit 218 in advance as a computer program, for example.

The peak correction unit 217 may display the peak D on the monitor (display unit) 220 through the display controller 219 if necessary.

Figure 13:
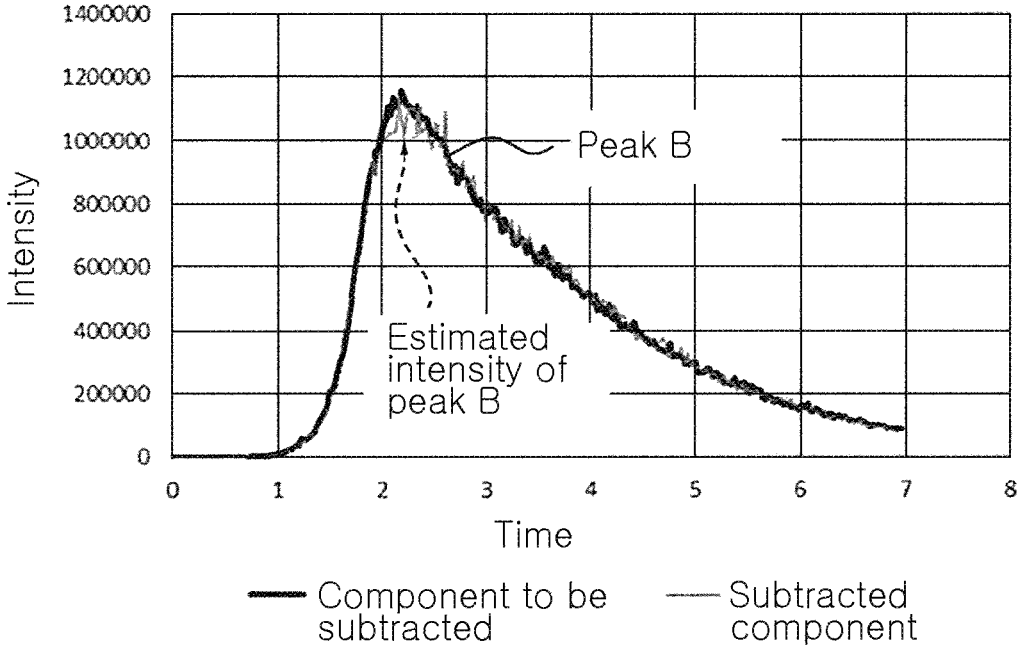
FIG. 13 is a view illustrating an example in which the estimated intensities and the intensities of the peak B are displayed for each time in a superimposed manner.

As illustrated in FIG. 13, the display controller 219 may display the estimated intensity and the intensity of the peak B on the monitor 220 every time in a superimposed manner.

In this way, it can be visually determined that the estimated intensity is correctly calculated based on the relation F as a waveform of the time variation of the estimated intensity approaches a waveform of the time variation of the intensity of the peak B.

Figure 14:
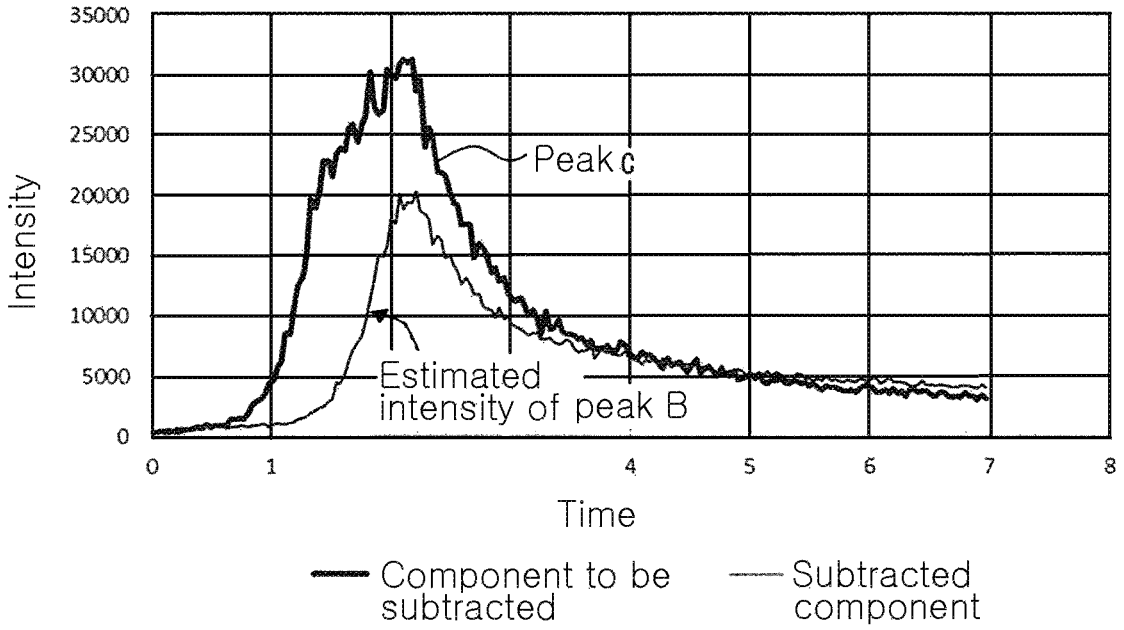
FIG. 14 is a view illustrating an example in which the estimated intensities of the peak B and the intensities of the peak C are displayed for each time in a superimposed manner.

As illustrated in FIG. 14, the display controller 219 may display the estimated intensity and the intensity of the peak C on the monitor 220 every time in a superimposed manner.

In this way, the remainder resulting from subtracting the estimated intensity from the intensity of the peak C is the intensity of the net peak D. When these waveforms (peak heights) are different from each other, it is visually determined that the estimated intensity is correctly calculated based on the relation F.

Time in FIGS. 13 and 14 may be equal to or different from the time interval Δt.

The present invention is not limited to the above embodiment. Accordingly, it should be understood that the present invention includes various modifications, equivalents, additions, and substitutions without departing from the scope and spirit of the invention.

The target substance and the interfering substance are not limited to the above embodiment, and a plurality of interfering substances may be used.

The peak A and the peak B are not limited to one. For example, when the interfering substance has two peaks A and one peak B, relation F between any one of the peaks A and the peak B may be used for correction. Alternatively, the peak B and an average of the two peaks A may be used for the correction.

When a interfering substance has one peak A and two peaks B, relation F between the peak A and one of the peaks B is used for correction of the corresponding peak B. Then, relationship F of the peak A and the remaining one of the peaks B is used for correction of the corresponding peak B.

A method of introducing a sample into an apparatus for mass analysis is not limited to the method of evolving the gas component by thermally decomposing the sample in the furnace, which is described above. For example, the method may be GC/MS or LC/MS of solvent extraction type in which a solvent containing a gas component is introduced and the gas component is evolved by volatilizing the solvent.

The ion source 50 is also not limited to APCI type device.

What is claimed is:

1. An apparatus for mass analysis, the apparatus analyzing a sample containing a target substance, which is an organic compound, and one or more interfering substances, which are organic compounds and have a peak of a mass spectrum overlapping that of the target substance, the apparatus comprising:

among peaks of a mass spectrum of a reference material of each of the interfering substances, based on a non-linear relation F of intensities between peak A that does not overlap a peak of a mass spectrum of the target substance and peak B that overlaps the peak of the target substance, a peak correction unit calculating an intensity of net peak D of the mass spectrum of the target substance by subtracting a total sum of estimated intensities of the peak B, which are calculated at every predetermined time interval based on the intensities of the peak A and the relation F, from an intensity of peak C of a mass spectrum of the target substance of the sample.

2. The apparatus of claim 1, wherein two or more interfering substances are present, and the peak correction unit subtracts a total sum of the estimated intensities of each of the interfering substances from the intensity of the peak C.

3. The apparatus of claim 1, wherein the peak correction unit calculates the intensity of the peak D when the estimated intensity exceeds a predetermined threshold value.

4. The apparatus of claim 1, further comprising:

an ion source ionizing the target substance and the interfering substance, wherein the peak B is resulted from fragment ions generated from the interfering substance during the ionization.

5. The apparatus of claim 1, further comprising:

a display controller displaying the estimated intensity and the intensity of the peak B on a predetermined display unit for each time in a superimposed manner.

6. The apparatus of claim 1, further comprising:

a display controller displaying the estimated intensity and the intensity of the peak C on a predetermined display unit for each time in a superimposed manner.

7. A method of mass analysis, the method analyzing a sample containing a target substance, which is an organic compound, and one or more interfering substances, which are an organic compound and have a peak of a mass spectrum overlapping that of the target substance, the method comprising:

among peaks of a mass spectrum of a reference material of each of the interfering substances, based on a non-linear relation F of intensities between peak A that does not overlap a peak of a mass spectrum of the target substance and peak B that overlaps the peak of the target substance, subtracting a total sum of estimated intensities of the peak B, which are calculated at every predetermined time interval according to the intensities of the peak A and the relation F, from an intensity of peak C of a mass spectrum of the target substance of the sample to calculate an intensity of net peak D of the mass spectrum of the target substance.

* * * * *